US006560892B2

(12) United States Patent
Chung et al.

(10) Patent No.: US 6,560,892 B2
(45) Date of Patent: May 13, 2003

(54) AIR BLOWING TOOL FOR HEAT-SHRINKABLE PACKING MATERIAL

(75) Inventors: Yueh Liang Chung, Tu-Chen (TW); Yang Jinn Chen, Tu-Chen (TW); Lipei Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/944,875

(22) Filed: Aug. 31, 2001

(65) Prior Publication Data

US 2002/0189130 A1 Dec. 19, 2002

(30) Foreign Application Priority Data

Jun. 15, 2001 (TW) ..... 90210059

(51) Int. Cl.[7] ..... F26B 21/06

(52) U.S. Cl. ..... 34/84; 34/202; 34/236; 34/218; 34/224; 34/232; 239/567; 432/229; 53/557; 53/442; 392/360

(58) Field of Search ..... 34/72, 83, 84, 34/202, 218–221, 227, 234, 236, 224, 225, 232, 233; 239/567, 601, 461, 472; 432/229; 53/442, 557; 392/360, 379

(56) References Cited

U.S. PATENT DOCUMENTS 2,345,672 A * 4/1944 Howse et al. ..... 239/552
3,027,355 A * 3/1962 Taul et al. ..... 526/65
3,668,370 A * 6/1972 Pattison ..... 392/385
3,916,602 A * 11/1975 Doty ..... 53/329.3
3,930,790 A * 1/1976 Rogosch ..... 432/229
4,026,475 A * 5/1977 Vicard ..... 239/468
4,207,685 A * 6/1980 Pelsue et al. ..... 34/107
4,528,802 A * 7/1985 Salzmann ..... 53/557
4,709,717 A * 12/1987 Rannigan et al. ..... 134/199
5,111,528 A * 5/1992 Hannen et al. ..... 329/379
5,297,739 A * 3/1994 Allen ..... 239/530
5,344,314 A * 9/1994 Zagoroff et al. ..... 432/222
5,407,135 A * 4/1995 Jeffs ..... 239/288
5,476,378 A * 12/1995 Zagoroff et al. ..... 432/222
5,546,677 A * 8/1996 Tolson ..... 34/216
5,842,524 A * 12/1998 Farmer ..... 169/45
6,304,720 B1 * 10/2001 Richard ..... 392/385
6,471,510 B1 * 10/2002 Chung et al. ..... 432/229

FOREIGN PATENT DOCUMENTS

JP 6-48424 A * 2/1994 ..... B65B/53/00

* cited by examiner

*Primary Examiner*—Ira S. Lazarus
*Assistant Examiner*—Andrea M. Ragonese
(74) *Attorney, Agent, or Firm*—Wei Te Chung

(57) ABSTRACT

An air blowing tool includes a connecting pipe (1) and an air blowing head (2). The air blowing head includes an inner wall (22) and an outer wall (21). An annular passage (24) is defined between the inner and outer walls. The inner wall encloses and defines a heating space (23) for accommodating a package (3) to be heated. An annular outlet (221) is defined in the inner wall. The annular outlet communicates with the annular passage and with the heating space.

8 Claims, 2 Drawing Sheets

AIR BLOWING TOOL FOR HEAT-SHRINKABLE PACKING MATERIAL

CROSS REFERENCE TO RELATED APPLICATIONS

This application is related co-pending application of Ser. Nos. 09/944,844, filed on Aug. 31, 2001; 09/944,864, filed on Aug. 31, 2001; and 09/945,291, filed on Aug. 31, 2001, now U.S. Pat. No. 6,471,510, issued Oct. 29, 2002.

BACKGROUND OF THE INVENTION

1. Field of the Invention

The present invention relates to heating devices for heat-shrinkable packing material, and particularly to devices for utilizing blowing of hot air over such packing material.

2. Description of the Related Art

Many products including optical communication components are very sensitive to environmental contamination, such as from dust or water. It is important to provide secure protection for such products during their transportation.

The usual way to protect products such as optoelectronic components is to pack them in plastic film. The plastic film is generally heat-shrinkable, and is first applied to loosely envelop the optoelectronic component. Then, heated air is below on the film. Once heated, the film shrinks to tightly pack the component. Conventional devices for heating the plastic film cannot blow hot air onto the plastic film uniformly. As a result blisters may be formed in the film, thus diminishing the aesthetic appearance of the product. Even worse, the film may break and expose the component to contamination.

In view of the above, there is a need for a tool which can blow hot air evenly onto the heat-shrinkable plastic film, to ensure that products such as optoelectronic components are properly protected and have an attractive appearance.

SUMMARY OF THE INVENTION

Therefore, an object of the present invention is to provide an air blowing tool which can blow heated air evenly onto heat-shrinkable material used for packing products such as optoelectronic components.

To achieve the object set out above, an air blowing tool of the present invention comprises a connecting pipe and an air blowing head. The connecting pipe has a first wide passage and a second narrow passage defined therein. The air blowing head includes an inner wall and an outer wall. An annular passage is defined between the inner and outer walls. The inner wall encloses and defines a heating space for accommodating a package to be heated. An annular outlet is defined in the inner wall. The annular outlet communicates with the annular passage and with the heating space.

Other objects, advantages and novel features of the invention will become more apparent from the following detailed description when taken in conjunction with the accompany drawings, in which:

DETAILED DESCRIPTION OF THE INVENTION

Figure 1:
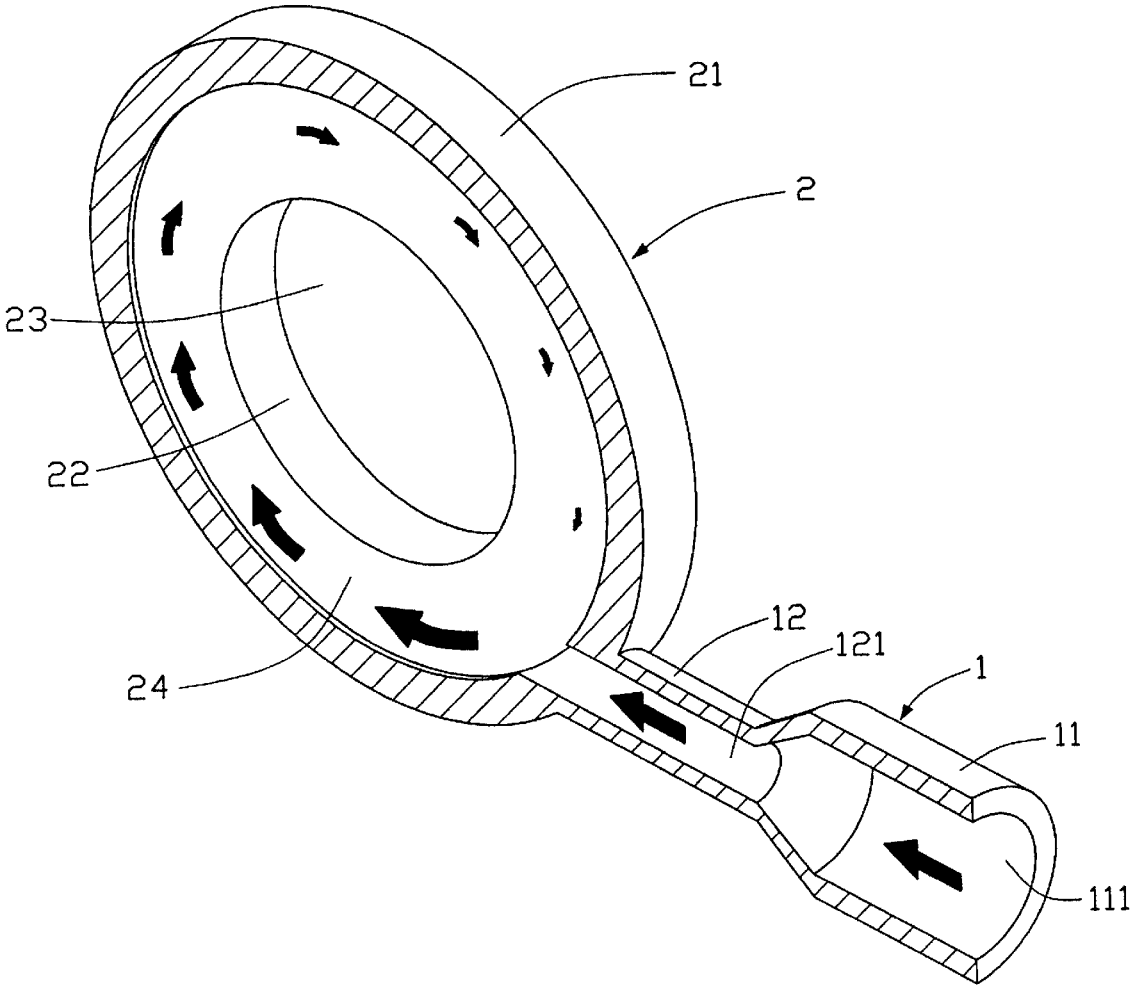
FIG. 1 is a cross-sectional view of an air blowing tool for a heating device for heat-shrinkable packing material in accordance with the present invention.

FIG. 1 is a cross-sectional view of an air blowing tool for a heating device for heat-shrinkable packing material in accordance with the present invention. The air blowing tool comprises a connecting pipe 1 and an annular air blowing head 2. The connecting pipe 1 comprises a first pipe 11, and a second pipe 12 integrally connected with the first pipe 11. The first pipe 11 has a first passage 111 connecting with an external blower (not shown) of the heating device (not shown). The first pipe 11 receives heated air from the blower. The second pipe 12 has a second passage 121. A diameter of the second passage 121 is less than a diameter of the first passage 111, so that hot air from the first passage 111 flows faster in the second passage 121.

The blowing head 2 connects with the second pipe 12 of the connecting pipe 1. The blowing head 2 comprises an outer wall 21 and an inner wall 22. The inner wall 22 encircles and defines a round heating space 23 therein. An annular passage 24 is defined in the blowing head 2 between the outer wall 21 and the inner wall 22. The second passage 121 of the connecting pipe 1 communicates with the annular passage 24 at an acute angle, to allow maximal airflow from the second passage 121 to the annular passage 24. An annular outlet 221 is defined in the inner wall 22. The annular outlet 221 communicates with the annular passage 24 and with the heating space 23. Thus air flow within the annular passage 24 can easily enter the annular outlet 221 and flow therethrough to reach the heating space 23. The annular outlet 221 is in communication with the annular passage 24 throughout an entire inmost circumferential extremity of the annular passage 24. Thus hot air from the annular passage 24 can flow uniformly and at a steady low speed into the heating space 23 via the annular outlet 221.

Figure 2:
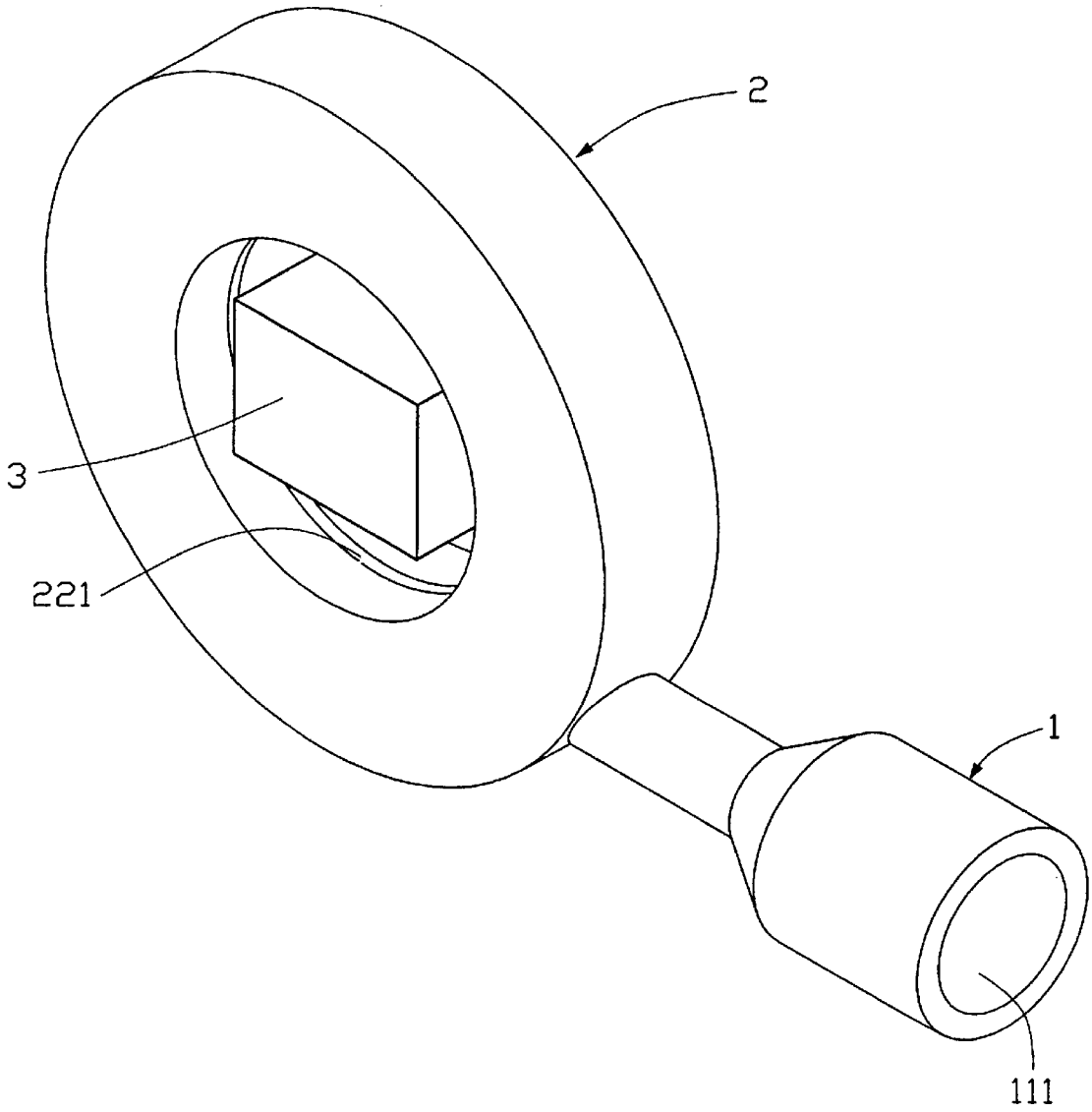
FIG. 2 is a perspective view of the air blowing of FIG. 1, together with a package enveloped by heat-shrinkable plastic film place in a space within an air blowing head of the air blowing tool.

Referring also to FIG. 2, in use, a package 3 comprises an optoelectronic component (not shown) enveloped by a heat-shrinkable plastic film 31. The package 3 is put in the heating space 23 of the blowing head 2. Hot air generated from the blower (not shown) flows into the connecting pipe 1. A speed and a temperature of the hot air are determined by the characteristics of the packing film and of the component. Such characteristics include a thickness and a composition of the film, and a size of the component. The hot air enters the annular passage 24 from the connecting pipe 1, and then enters the heating space 23 via the outlet 221. The film 31 is thereby heated up uniformly, and shrinks to be tightly attached onto surfaces of the package 3.

Because the annular outlet 221 is in communication with the annular passage 24 throughout an entire inmost circumferential extremity of the annular passage 24, hot air flows into the annular outlet 221 easily and quickly. Furthermore, because the heating space 23 has a circular configuration, the hot air exiting the annular outlet 221 forms a circular path of air flow around the package 3 in the heating space 23. Therefore the plastic film 31 is heated evenly, and shrinks evenly to encase the component tightly, uniformly, and in an aesthetically pleasing form.

It should be understood that various changes and modifications to the presently preferred embodiment described herein will be apparent to those skilled in the art. Such changes and modifications may be made without departing from the spirit and scope of the present invention and without diminishing the present invention's advantages. Thus, it is intended that such changes and modifications be covered by the appended claims.

What is claimed is:

1. A tool for blowing hot air onto heat-shrinkable packing material, the tool comprising:

a connecting pipe adapted to be connected with a hot air blower; and an annular air blowing head comprising an outer wall, an inner wall, and an annular passage defined between the outer and inner walls and communicating with the connecting pipe, a circular heating space being defined inwardly from the inner wall and adapted for receiving a package having heat-shrinkable packing material, the head further comprising an annular outlet defined in the inner wall, the annular outlet communicating with the annular passage and with the heating space; wherein the annular outlet communicates with the annular passage throughout an entire inmost circumferential extremity of the annular passage.

2. The tool as described in claim 1, wherein the connecting pipe includes a first pipe and a second pipe, the first pipe has a first passage, the second pipe has a second passage, a diameter of the second passage is less than a diameter of the first passage, and the annular passage of the head communicates with the second passage.

3. The tool as described in claim 2, wherein the second passage communicates with the annular passage at an acute angle.

4. A hot air blowing tool, comprising:

a pipe adapted for receiving hot air flow; and an air blowing head integrally formed with the pipe, the head comprising an outer wall, an inner wall and an air passage defined between the outer and inner walls and in communication with the pipe, a perimeter outlet being defined in the inner wall, the perimeter outlet communicating with the air passage and a space surrounded by the inner wall.

5. The tool as described in claim 4, wherein the head has an annular configuration, the air passage is annular, and the perimeter outlet is annular.

6. The tool as described in claim 4, wherein the perimeter outlet communicates with the air passage throughout an entire inmost circumferential extremity of the air passage.

7. The tool as described in claim 6, wherein the pipe has a large passage and a small passage, and the small passage communicates with the air passage of the head.

8. In combination, a tool comprising:

a connecting pipe adapted to be connected to a hot air blower, and an annular air blowing head comprising an outer wall and an inner wall commonly defining therebetween an annular passage in communication with said connecting pipe;

a circular heating space defined inside the inner wall;

an annular outlet disposed in an entire circumferential portion of the inner wall and extending therethrough to communicate with both the space and the annular passage;

a package having heat-shrinkable packing material and disposed in a center portion of the space; and the connecting pipe being directed generally along a tangent line of said space toward the annular passage.

* * * * *